US005948144A

United States Patent [19]

Cifuni

[11] Patent Number: 5,948,144

[45] Date of Patent: Sep. 7, 1999

[54] LYOPHILIZER SYSTEM

[75] Inventor: Charles G. Cifuni, Malden, Mass.

[73] Assignee: Genetics Institute, Inc., Cambridge, Mass.

[21] Appl. No.: 08/946,178

[22] Filed: Oct. 7, 1997

[51] Int. Cl.[6] ..... F26B 5/06

[52] U.S. Cl. ..... 95/246; 95/247; 95/257; 95/266; 34/92; 34/284

[58] Field of Search ..... 34/5, 15, 92, 284; 95/246, 247, 257, 266

[56] References Cited

U.S. PATENT DOCUMENTS

| | | | |
|---|---|---|---|
| 3,601,901 | 8/1971 | Rader | 34/92 |
| 3,731,392 | 5/1973 | Gottfried | 34/5 |
| 4,033,048 | 7/1977 | Van Ike | 34/92 |
| 4,251,923 | 2/1981 | Kuri | 34/15 |
| 4,468,866 | 9/1984 | Kendall . | |
| 4,561,191 | 12/1985 | Parkinson . | |
| 4,802,286 | 2/1989 | Kobayashi et al. | 34/15 |
| 5,131,168 | 7/1992 | Rilke et al. . | |

*Primary Examiner*—Jay H. Woo
*Assistant Examiner*—Minh-Chau T. Pham
*Attorney, Agent, or Firm*—Steven R. Lazar; Barbara A. Gyure

[57] ABSTRACT

Apparatus and methods are disclosed for lyophilization of protein and/or pharmaceutical products, wherein said apparatus utilizes a dry vacuum pump for the direct removal of water vapor, rather than a cold trap condenser. A freeze dryer has a vacuum pump which is connected directly to a drying chamber without the use of a cold trap condenser. The exhaust of the vacuum pump is vented directly to atmosphere. Water vapor generated in the process is directly removed from the chamber by the vacuum pump. The apparatus permits lyophilization of pharmaceuticals e.g. antibiotics, vitamins products, vaccines, and biological protein solutions. The dryer operates on a batch basis or may be designed to perform continuous production.

6 Claims, No Drawings

LYOPHILIZER SYSTEM

FIELD OF THE INVENTION

The present invention relates to improved methods and apparatus for lyophilization processes. More specifically, the present invention relates to methods and apparatus of lyophilization which more efficiently removes water vapor from the process environment during controlled freeze drying of a product, such as a recombinantly produced protein or other pharmaceutical.

BACKGROUND OF THE INVENTION

To date, lyophilizer systems have included the use of a cold trap condenser. The condenser is designed to capture the full volume of ice sublimating from frozen product during lyophilization. After product is frozen on the freeze dryer shelves a vacuum is applied to the product chamber lowering the vapor pressure of the ice present. This action results in the initiation of sublimation. The low pressure created by pulling a vacuum allows water molecules to diffuse directly from the solid state "ice" to the gas state "water vapor." Since sublimation of ice to water vapor takes energy, the shelves must be heated to continue the process. Water molecules will continue to sublimate unless an equilibrium is reached between the water molecules present as vapor in the chamber and those sublimating from the ice. To prevent an equilibrium condition from affecting the sublimation rate, water vapor must be removed from the processing chamber. By removing the water vapor, a diffusion gradient will be maintained between the product and the environment within the chamber. Other methods presently used for capturing water vapor during freeze drying include the use of brine solutions and desiccants. These methods both work by indirect water vapor removal from the processing environment.

In present lyophilizing systems, once sublimation is initiated, water vapor is recaptured by a cold trap condenser prior to it reaching the vacuum pump. The condenser acts as a "water molecule pump" for the condensable gas "water vapor." The condenser captures condensable water vapor released during sublimation by removing heat from the vapor. Removing the heat causes the vapor to recrystallize onto the condenser plates as ice. This process provides the means by which a diffusion gradient is maintained between the product shelves and the condenser so that sublimation will continue. The condenser is normally operated at a temperature significantly lower than that of the product shelves. Heat energy must be supplied to the product shelves at a rate that will allow ice in the product to sublimate while maintaining the product temperature below its freezing point.

SUMMARY OF THE INVENTION

Accordingly, it is one object of the present invention to provide lyophilization systems in which ice sublimated directly from the product will be completely eliminated from the process environment as water vapor. It is a further object of the present invention to eliminate the use of a cold trap condenser, thus allowing for potentially more efficient lyophilization, or freeze-drying, processes. This is accomplished by using an innovative approach by which the vacuum pumping system, customarily used only to remove non-condensable gases, will now be employed to remove water vapor as well. The new design for freeze drying system will allow the direct elimination of water vapor from the process.

The methods and apparatus of the present invention have many additional benefits. The use of vacuum pumps which can tolerate large volumes of water vapor, will be referred to as dry vacuum pump for the purposes of this discussion. Use of dry vacuum pumps eliminates the need for a cold trap condenser system, which includes refrigeration compressor (s), refrigerant, stainless steel condenser, associated plumbing, heat exchanger and cooling water plumbing. The apparatus of the present invention requires less space due to the elimination of the space required to house the condenser cold trap chamber. This allows more space to be available for processing additional product. Use of the dry vacuum pump also eliminates condenser ice capacity as a limiting factor for product load size. The volume of ice sublimated from the product no longer needs to be maintained frozen on condenser plates in the process environment. Water vapor is exhausted directly from the system through the dry vacuum pump where it can be condensed as liquid and sent to drain. This allows any volume of ice present in the chamber to be expelled over time. Further, because condenser thaw or reverse sublimation is not possible, the possibility of ice thawing on the condenser and effecting the process is eliminated. Not having ice on the condenser also eliminates the need to thaw the condenser between process runs. The electrical energy requirements for operation of high powered refrigeration compressors is not required. Lower quantity of expensive refrigerant requirements is needed. Because the vacuum pump discharge from the product chamber will carry water molecules still evolving from the product, it is possible to directly analyze and accurately determine the residual moisture levels left in the product prior to ending the run. This allows greater opportunity for accurate on line monitoring of residual moisture levels. Seen from all of the above points, the complexity of the freeze dryer system is dramatically reduced. This equipment design should lead to an increase in reliability, a reduction of process turn-around time and a significant reduction in maintenance. This design should also reduce the complexity of system validation requirements for application to lyophilized pharmaceutical products.

The opportunity for continuous production also becomes more feasible with this approach. Since there is no collection of ice on a limited capacity condenser, production can be made continuous by introduction of product to and removal from the drying chamber without interrupting the process. Using a condenser type system requires dealing with ice removal from the condenser in order to prevent inhibition of ongoing processing. Even with a switchable two condenser system the complexity of such a system would be much greater as compared to the direct water vapor removal approach.

The money saved in the reduction of system complexity should offset the increased cost of the new equipment needed. It is anticipated that the increase in efficiency and reliability, along with the reductions in maintenance and energy costs and potentially shorter process time, will lead to significant savings over the lifetime of the equipment.

Until recently vacuum pumps capable of achieving and maintaining the vacuum levels necessary for sublimation to occur could not tolerate exposure to great quantities of water vapor. For many of these pumps to work properly oil is required to provided lubrication and the sufficient sealing necessary to achieve the right conditions. If water vapor enters these pumps it will condense in the pump oil. The presence of water in the oil causes these pumps to lose vacuum efficiency and fail. To circumvent problems of dealing with large quantities of water vapor, lyophilizers have been designed to utilize vacuum pumps to establish the necessary low pressure environment by removing "non-condensable" gases only. Unlike water vapor, non-condensable gases pass right through the oil without affecting the operation of the pump.

DETAILED DESCRIPTION OF THE INVENTION

The present invention incorporates replacement of the standard vacuum pump system with a newer design vacuum pump system which can tolerate exposure to water vapor. Vacuum pumps which can tolerate exposure to large quantities of water vapor are referred to herein as "dry vacuum pumps." With some system modifications, other types of pumping systems may potentially handle sufficient volumes of water vapor and may therefore be useful in the present invention. These systems are included in the definition of "dry vacuum pump" according to the present invention. Dry vacuum pumps are relatively new to the market and use of them in lyophilization applications has not been considered until now.

Dry vacuum pumps can pass 100% water vapor and up to 1 quart of liquid water per minute. Dry vacuum pumps can handle both "non-condensable gases" and "water vapor." It was found through studies that for optimal performance, the vacuum pump should preferably provide a maximum pressure of about 1 Torr, with an evacuation rate of about 5 cubic feet per minute, per square inch of ice surface area. To better define this pressure feature, the majority of the 1 Torr pressure control provided to the product chamber was a function of bleeding gases other than water vapor, for example dry air or nitrogen. With the product chamber isolated from additional water vapor load, the withdrawal rate of water vapor evolving due to sublimation becomes a function of volumetric removal rate by the vacuum pump. In other words, even though the overall pressure seen in the chamber increases, the partial pressure of the water vapor is maintained at a low level.

Use of these pumps eliminates the need for a cold trap condenser since they can remove water vapor directly from the product chamber to atmosphere without a loss in vacuum efficiency. Once removed from the freeze dryer, water vapor can be condensed as liquid and sent to drain.

Dry vacuum pumps preferably operate at an internal temperature of about 150° C. The temperature is preferably well above the vapor pressure of water even on the atmospheric side of the pump. At such temperatures, water contacting the vacuum pump will vaporize (boil) and will be pumped out of the system. This explains why dry vacuum pumps have no trouble expelling water vapor as well as limited quantities of liquid water. The other benefit of this temperature range is that it prevents microbe contaminants from getting in (or out) of the chamber since they would be sterilized by these temperatures when passing through the pump.

Freeze-drying requires significant energy input to supply heat to the product shelves in order for sublimation to proceed. Present systems require even more energy to be expended to produce enough cold in the condenser to remove the heat from the water vapor to recapture it back as ice. In the present invention, water vapor generated during the sublimation process will be removed directly from the freeze dryer. This will eliminate the energy requirement for the recovery of water vapor as ice on the condenser.

EXAMPLES

To demonstrate the utility of such a freeze dryer design, several experiments were conducted in a standard small scale freeze dryer modified to allow processing without the use of a condenser cold trap.

A Virtis Freezemobile freeze dryer was set up so that only the shelf temperature control system was operable. The condenser was sealed off and the vacuum system was modified to expel larger quantities of water vapor during freeze drying. Results of these experiments demonstrated that lyophilization of liquid product can be accomplished under conditions without a condenser. Water vapor which evolved from frozen solution during freeze drying was removed directly from the product chamber and eliminated out through the vacuum pumping system. The formulation was dried in equal or even less time than would be possible using a condenser cold trap in the system. Lyophilized cakes looked as good or better than those produced with a cold trap condenser in operation.

The physics of water vapor removal were found to be different between the two methods. Using the cold trap condenser prevents the water vapor liberated from the product from expanding in the process chamber thus increasing the pressure. The vapor is immediately cooled as it comes in contact with the condenser. This action curbs any pressure rise in the chamber by minimizing gas expansion. The condenser then recaptures the water vapor out of the process environment as solid "ice." The gas pressure of the water vapor is kept low because it never has a chance to pick up any additional heat energy. The water vapor is removed from the process by converting the gas directly back to a solid. The solid is then maintained inside the processing environment as ice. This method is highly sensitive to temperature and pressure variation which effect both sublimation at the product and condensation of water at the condenser.

When using dry vacuum pumps without the presence of a cold trap condenser, the water vapor liberated from the product comes in contact with the walls of the process chamber. The metal walls of the chamber are not refrigerated and conduct heat from the surroundings. Water molecules that come in contact with the warmer surfaces increase in temperature and thus add pressure to the system. Dry vacuum pumps remove water vapor by pumping at a specific volumetric rate. The specific volume removed will contain water vapor based on the number of molecules present. The pressure in the specific volume of gas is a function of both the number of molecules present and temperature. Because in this method water vapor molecules are totally removed from the process environment by constant withdrawal, water removal and sublimation proceed efficiently over a wider temperature and pressure range. Using this method of lyophilization, the shelf temperature should be controlled to allow enough heat to be available for sublimation to proceed efficiently while at the same time prevent the product temperature from rising above the critical melting point of the product cake being dried.

The methods of the present invention for lyophilization design are feasible not only for newly constructed equipment but may be retrofitted into existing freeze dryers as well. With the many advantages over present systems as indicated, upgrading existing equipment may be justifiable also.

I claim:

1. A lyophilizer apparatus comprising a dry vacuum pump which removes water vapor directly from the apparatus through the dry vacuum pump, wherein said dry vacuum pump provides a maximum pressure of about 1 Torr.

2. A lyophilizer apparatus of claim 1, wherein said apparatus does not comprise a cold trap condenser.

3. A lyophilizer apparatus of claim 2, wherein said dry vacuum pump is able to remove both non-condensable gases and water vapor.

4. A method for lyophilizing a product, wherein the improvement consists of directly removing water vapor through use of a dry vacuum pump, wherein said dry vacuum pump provides a maximum pressure of about 1 Torr.

5. A method according to claim 4, wherein said method does not comprise using a cold trap condenser.

6. A method according to claim 5, wherein said dry vacuum pump is able to remove both non-condensable gases and water vapor.

* * * * *